US010759503B2

(12) United States Patent
Aguera

(10) Patent No.: US 10,759,503 B2
(45) Date of Patent: Sep. 1, 2020

(54) HYDROFOIL-BASED APPARATUS

(71) Applicant: Go Foil, INC., Haiku, HI (US)

(72) Inventor: Alex Leslie Aguera, Haiku, HI (US)

(73) Assignee: Go Foil, Inc., Haiku, HI (US)

( * ) Notice: Subject to any disclaimer, the term of this patent is extended or adjusted under 35 U.S.C. 154(b) by 0 days.

(21) Appl. No.: 16/227,358

(22) Filed: Dec. 20, 2018

(65) Prior Publication Data

US 2019/0127031 A1 May 2, 2019

Related U.S. Application Data

(63) Continuation of application No. 15/784,996, filed on Oct. 16, 2017, now Pat. No. 10,160,525, which is a continuation-in-part of application No. 15/430,805, filed on Feb. 13, 2017, now Pat. No. 9,789,935.

(60) Provisional application No. 62/337,706, filed on May 17, 2016.

(51) Int. Cl.

| | |
|---|---|
| ***B63B 1/26*** | (2006.01) |
| ***B63B 32/60*** | (2020.01) |
| ***B63B 1/24*** | (2020.01) |

(52) U.S. Cl.

CPC ..... *B63B 32/60* (2020.02); *B63B 1/248* (2013.01); *B63B 1/26* (2013.01)

(58) Field of Classification Search

CPC ..... B63B 1/248; B63B 1/26; B63B 35/7926
See application file for complete search history.

(56) References Cited

U.S. PATENT DOCUMENTS

| | | | |
|---|---|---|---|
| 3,747,138 | A | 7/1973 | Morgan |
| 3,890,661 | A | 6/1975 | Johnson |
| 5,211,594 | A | 5/1993 | Barrows |
| 5,249,998 | A | 10/1993 | Woolley et al. |
| 5,544,607 | A | 8/1996 | Rorabaugh et al. |
| 6,901,873 | B1 | 6/2005 | Lang et al. |
| 7,047,901 | B2 | 5/2006 | Chen |
| 9,056,654 | B1 | 6/2015 | Fraser |
| 9,278,739 | B2 | 3/2016 | Salles |
| 9,359,044 | B2 | 6/2016 | Langelaan |
| 9,789,935 | B1 | 10/2017 | Aguera |
| 10,160,525 | B2 | 12/2018 | Aguera |

(Continued)

OTHER PUBLICATIONS

US 9,278,729 B2, 03/2016, Langelaan (withdrawn)

(Continued)

*Primary Examiner* — Stephen P Avila
(74) *Attorney, Agent, or Firm* — Greenberg Traurig

(57) ABSTRACT

Disclosed is an apparatus, optionally mounted on a stand up paddle board, or surfboard, to lift the board above the water surface and support the board in a stable position above the water surface while a rider standing on the board and maintaining a speed in the water via paddling. In one embodiment, the apparatus includes a strut; a fuselage connected to said strut; a back foil portion connected to an aft end of said fuselage wherein the back foil portion includes two back wings extending outwardly from said aft end of said fuselage; and a forward foil portion connected to a fore end of said fuselage wherein the forward foil portion includes two front wings extending outwardly from said fore end of said fuselage and wherein the forward foil portion has a maximum thickness located at first distance from the fore edge of the forward foil portion.

17 Claims, 9 Drawing Sheets

(56) References Cited

U.S. PATENT DOCUMENTS

| | | | | |
|---|---|---|---|---|
| 2014/0182500 | A1* | 7/2014 | White, I ..... | B63B 15/0083 114/39.31 |
| 2015/0017850 | A1 | 1/2015 | Modica et al. | |
| 2015/0104985 | A1 | 4/2015 | Langelaan | |
| 2015/0225040 | A1 | 8/2015 | Geislinger | |
| 2015/0314837 | A1 | 11/2015 | Salles | |
| 2018/0050768 | A1 | 2/2018 | Aguera | |

OTHER PUBLICATIONS

International Patent Application No. PCT/US2017/018243, International Search Report and Written Opinion, dated May 5, 2017.
Surfer Today, Naish Malolo: the future of SUP has foils (May 2, 2016), available at http://www.surfertoday.com/surfing/12755-naish-malolo-the-future-of-sup-has-foils.
Title: Hydrofoil-based Apparatus, U.S. Appl. No. 15/430,805, filed Feb. 13, 2017, Inventor: Alex Aguera, U.S. Pat. No. 9,789,935, Issue Date: Oct. 17, 2017.
Title: Hydrofoil-based Apparatus, U.S. Appl. No. 15/784,996, filed Oct. 16, 2017, Inventor: Alex Aguera, U.S. Pat. No. 1,016,0525, Issue Date: Dec. 25, 2018.

* cited by examiner

HYDROFOIL-BASED APPARATUS

CLAIM OF PRIORITY

The present application is a Continuation application of U.S. patent application Ser. No. 15/784,996, filed Oct. 16, 2017, entitled "Hydrofoil-Based Apparatus," which is a Continuation-In-Part (CIP) application of U.S. patent application Ser. No. 15/430,805, filed Feb. 13, 2017, entitled "Hydrofoil-Based Apparatus," and issued Oct. 17, 2017 as U.S. Pat. No. 9,789,935, which claims priority benefit of U.S. Prov. Pat. App. Ser. No. 62/337,706, filed May 17, 2016, entitled "Stand Up Paddle (SUP) Foil Boards," the disclosures of which patent applications are hereby incorporated by reference in their entirety.

COPYRIGHT NOTICE

This application includes material that may be subject to copyright protection. The copyright owner has no objection to the facsimile reproduction by anyone of the patent disclosure, as it appears in the Patent and Trademark Office files or records, but otherwise reserves all copyright rights whatsoever.

BACKGROUND

A hydrofoil is a device designed to provide "lift" to watercraft such as surfboards, sailboats, and other watercraft. Generally, a hydrofoil comprises a wing-like structure connected to a watercraft via one or more struts. As a watercraft increases in speed, the flow of water across the foil generates lift which, in turn, raises the watercraft and results in increased speed and, for powered watercraft, a decrease in fuel expenditure.

The effectiveness of a hydrofoil depends, in part, on its design. As a general rule, the thickness and dimensions of a hydrofoil directly impact the effectiveness of the hydrofoil in providing lift. Additionally, the design of hydrofoils is impacted by the intended use of the hydrofoil. For example, in recreational uses, one must consider the safety of the participant when designing, for example, the strut length, to avoid potential injuries that may occur upon "wipeouts."

While often used for powered watercraft, hydrofoils may be employed in a variety of watersports such as stand up paddle ("SUP") surfing or SUP boarding. SUP surfing and SUP boarding are sports where SUP boarders or riders maintain an upright stance on their boards and use a paddle to propel themselves through the water. There are various modes of stand up paddling, including flat water paddling for outdoor recreation, fitness, or sightseeing, racing on lakes, large rivers and canals, surfing on ocean waves, paddling in river rapids (whitewater SUP), SUP Yoga, and even fishing.

Hydrofoils for watersports such as SUP surfing, regular prone surfing, or SUP boarding have previously been implemented but suffer from numerous drawbacks. Generally, most existing hydrofoil designs utilize a long strut length which can potentially can result in serious injury, especially for inexperienced riders. Additionally, most hydrofoils (for both watersports and powered vessels) utilize thin forward main lifting wings (in canard style foil setups it is the back wing as the main lifting wing) and have a symmetrical thickness across the chord length of the main lifting wing.

BRIEF SUMMARY

In order to remedy the above deficiencies, a new hydrofoil apparatus is disclosed herein.

In one embodiment, an apparatus includes a strut; a fuselage connected to said strut; a back foil portion connected to an aft end of said fuselage wherein the back foil portion includes two back wings extending outwardly from said aft end of said fuselage; and a forward foil portion connected to a fore end of said fuselage wherein the forward foil portion includes two front wings extending outwardly from said fore end of said fuselage and wherein the forward foil portion has a maximum thickness located at first distance from the fore edge of the forward foil portion.

In another embodiment, a paddleboard is disclosed which includes a board portion having a tail end; a strut; a fuselage connected to said strut; a back foil portion connected to an aft end of said fuselage wherein the back foil portion includes two back wings extending outwardly from said aft end of said fuselage; and a main lifting foil portion connected to a fore end of said fuselage wherein the main lifting foil portion includes two wings extending outwardly from said fore end of said fuselage and wherein the main lifting foil portion has a maximum thickness located at first distance from the fore edge of the main lifting foil portion.

In another embodiment, an apparatus includes a strut wherein the strut is between 18 and 30 inches in length, and in another embodiment the strut is between 18 and 34 inches. In one embodiment, the strut is of variable thickness and has a maximum thickness located midway along the chord length of the strut; a fuselage connected to said strut; an anhedral-shaped opposite foil portion connected to an aft end of said fuselage wherein the opposite foil portion includes two back wings extending outwardly from said aft end of said fuselage; and an anhedral-shaped main lifting foil portion connected to a fore end of said fuselage wherein the main lifting foil portion includes two wings extending outwardly from said fore end of said fuselage and wherein the main lifting foil portion has a maximum thickness located at first distance equal to 20 to 33 percent of the chord length of the main lifting foil portion and wherein the maximum thickness aspect ratio of the main lifting foil portion is between 14% and 17%. That is, the aspect ratio is equal to the maximum thickness divided by the chord length of the foil. The maximum draft area thickness forward at 20 to 33%, coupled with the thicker foils at one of: 25 to 45 millimeters, 25 to 55 millimeters, or 25 to 65 millimeters, and the thickness aspect ratio of 14 to 17% result in the disclosed hydrofoil lifting more weight at slower speeds than existing hydrofoils.

BRIEF DESCRIPTION OF THE DRAWINGS

The foregoing and other objects, features, and advantages of the disclosure will be apparent from the following description of embodiments as illustrated in the accompanying drawings, in which reference characters refer to the same parts throughout the various views. The drawings are not necessarily to scale, emphasis instead being placed upon illustrating principles of the disclosure.

Like reference symbols in the various drawings indicate like elements.

DETAILED DESCRIPTION

Disclosed herein is an improved hydrofoil apparatus. In some embodiments, the disclosed apparatus may be used in connection with stand up paddleboards, surfboards, or other watercraft. Generally, the hydrofoil apparatus includes a strut, a fuselage connected to the strut, and two sets of hydrofoils located at the forward and aft ends of the fuselage. The main lifting foil portion of the hydrofoil apparatus is constructed in a specific manner so as to provide significant lift at low speeds compared to current hydrofoil designs. Notably, the main lifting foil portion is significantly thicker than current hydrofoil designs has a maximum thickness located further forward, and an aspect percentage ratio greater than current designs. When using a Canard style foil setup, the main lifting wing is the back wing and will have the characteristics stated and pictured in FIG. 9.

Figure 1:
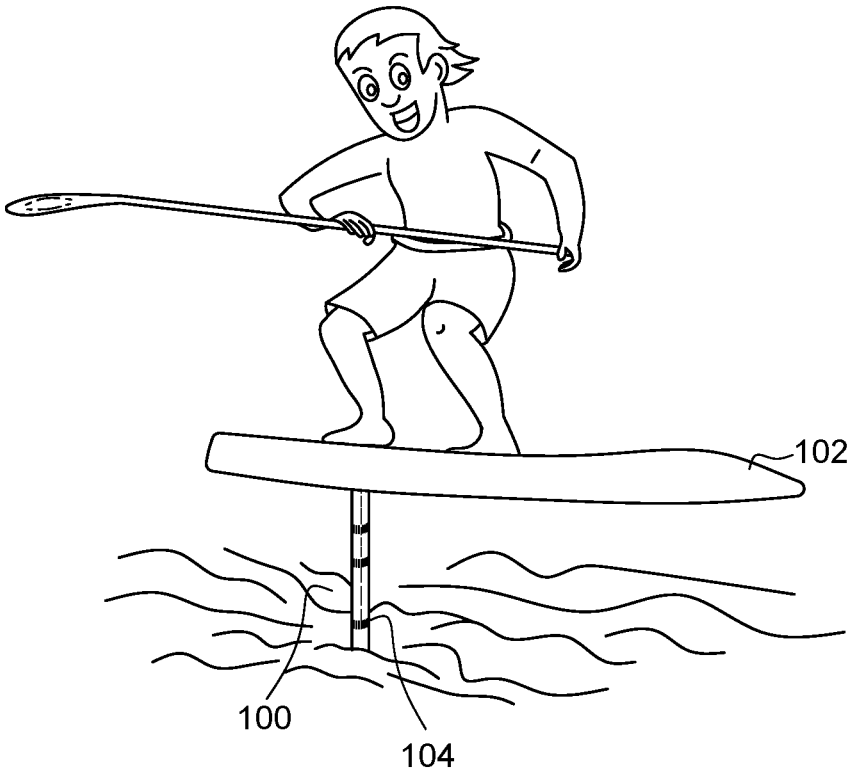
FIG. 1 is a diagram illustrating the use of a hydrofoil apparatus, according to one embodiment of the disclosure.
Figure 2:
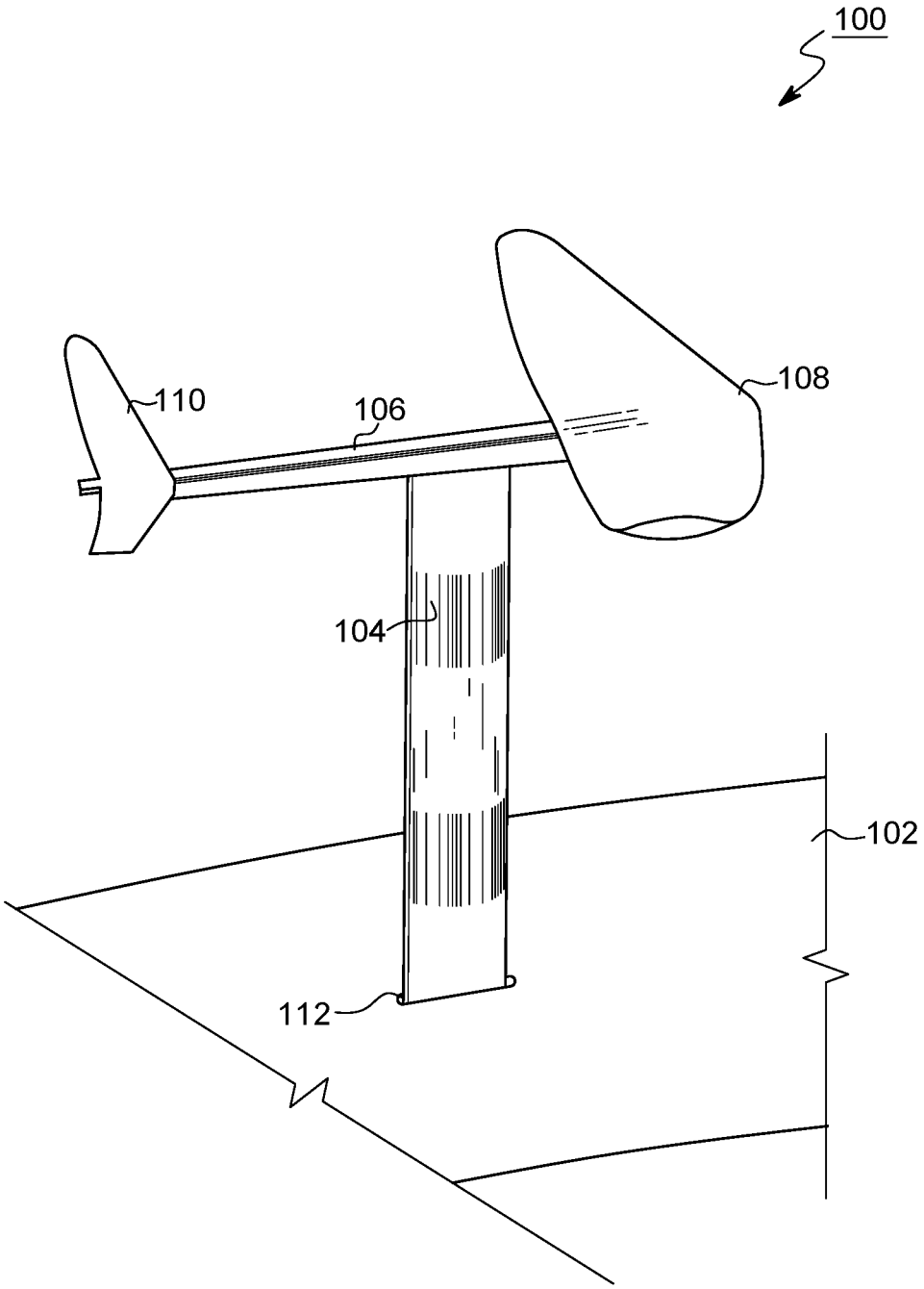
FIG. 2 is a diagram illustrating a perspective view of a hydrofoil apparatus, according to one embodiment of the disclosure.
Figure 3:
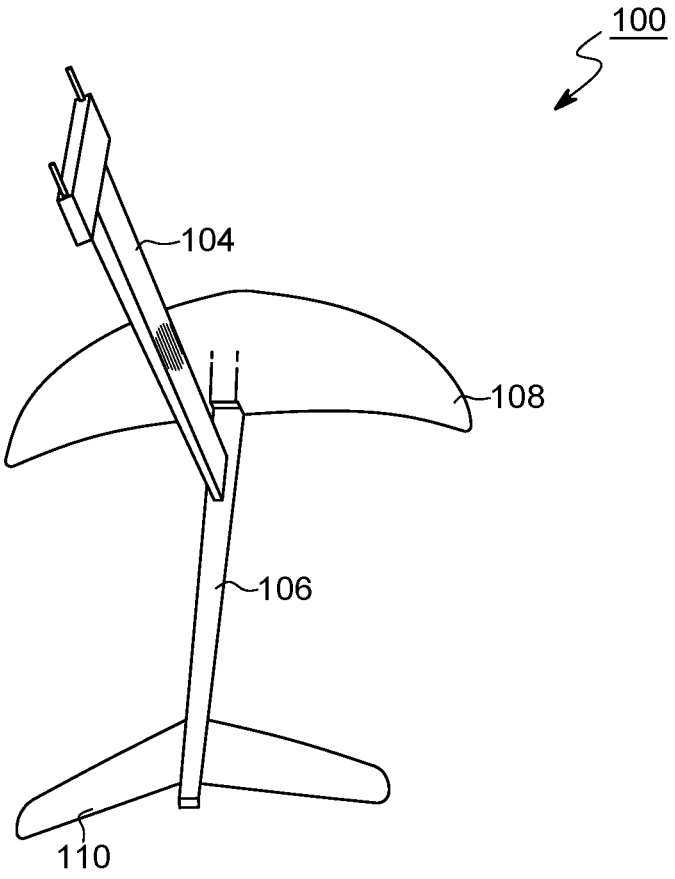
FIG. 3 is a diagram illustrating a top view of a hydrofoil apparatus, according to one embodiment of the disclosure.
Figure 4:
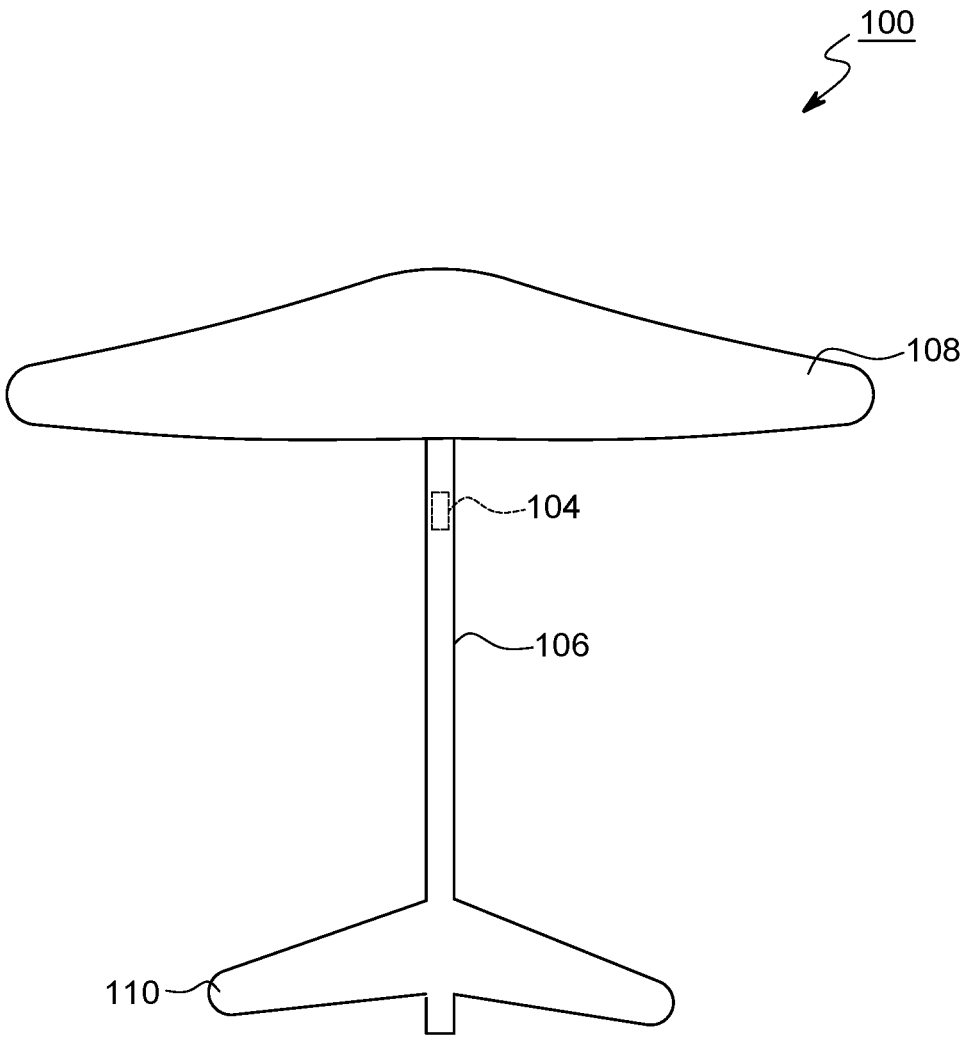
FIG. 4 is a diagram illustrating a bottom view of a hydrofoil apparatus, according to one embodiment of the disclosure.
Figure 5:
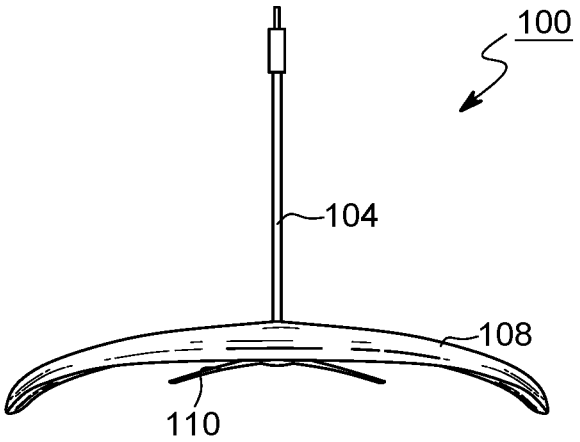
FIG. 5 is a diagram illustrating a front view of a hydrofoil apparatus, according to one embodiment of the disclosure.
Figure 6:
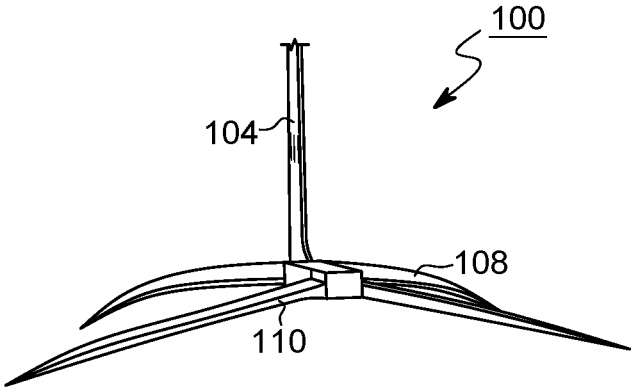
FIG. 6 is a diagram illustrating a back view of a hydrofoil apparatus, according to one embodiment of the disclosure.
Figure 7:
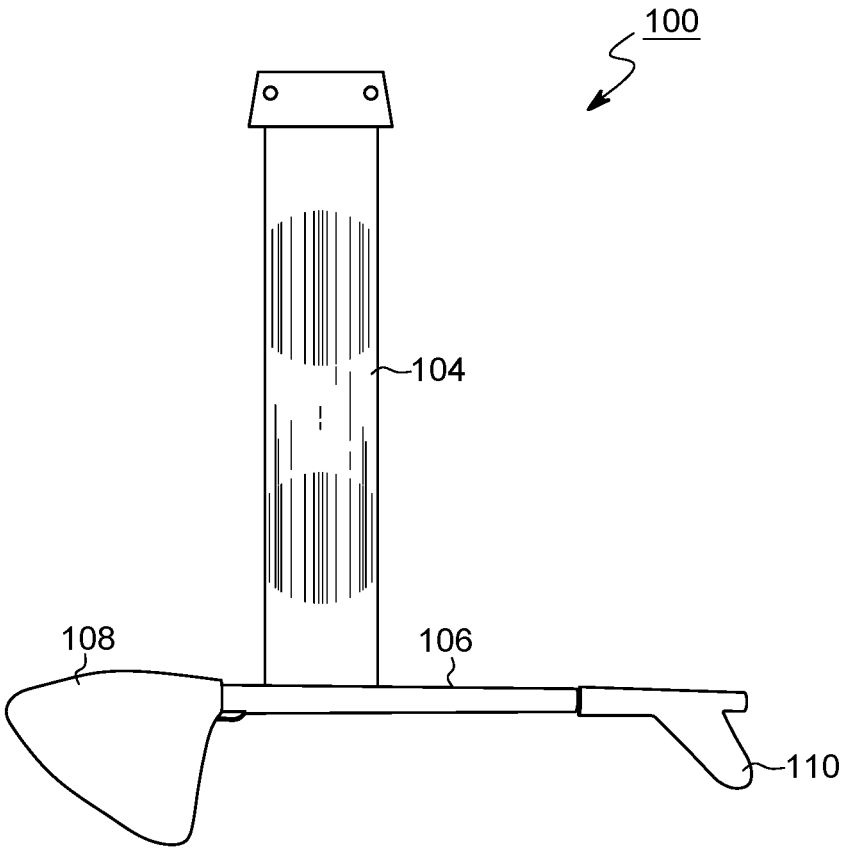
FIG. 7 is a diagram illustrating a side view of a hydrofoil apparatus, according to one embodiment of the disclosure.

FIG. 1 is a diagram illustrating the use of a stand up paddle foil, according to one embodiment of the disclosure.

As the embodiment of FIG. 1 illustrates, a stand up paddle (SUP) board 102 may be equipped with a hydrofoil apparatus 100. In one embodiment, the apparatus 100 is configured to be mounted on a board 102 (via strut 104) to lift the board 102 above the water surface and support the board 102 in a stable position above the water surface while a rider standing on the board 102 and maintains a speed in the water via paddling. Currently, regular kite foil and windsurfer foil wings cannot provide sufficient lift to raise a stand up paddle board (and its rider) out above the water surface at speeds involved in stand up paddle surfing and stand up paddle boarding. This is because the energy and speed of the foil going through the water is much less when paddling as opposed to when being powered by a kite or sail.

In one embodiment, the apparatus is configured to with a larger forward wing size and a thicker foil cross-section, as compared to existing designs. The foil(s) of the apparatus can create sufficient lift for the board and the rider at a speed of 6 or 7 knots while traveling in the water. Currently, a speed of 11 or 12 knots is rarely approachable in the standup paddle surfing and stand up paddle boarding, yet current foils require a speed of 11 or 12 knots to generate sufficient lift for the board and the rider.

In one embodiment, the foils can be mounted on a faster race board which is much easier to get up to a required speed than a wave SUP. Foiling requires the rider to angle board up in the same way an airplane takes off from the runway. Once up and foiling, the rider levels off the nose by using the body weight of the rider to stabilize at a certain level off the water.

In one embodiment, flexible front and aft wings may be used to allow for a "bird-like" flapping effect in lower, flatter water races which, in turn, creates a pendulum effect on the board 102. This motion is similar to bouncing up and down and in turn creates a faster flow of water over the forward and opposite foil portions and creates extra lift similar to a bird flapping his wings. When not foiling or starting to lose the foil, rider can bounce the wings and create a longer foiling position above the water.

In one embodiment, the apparatus for stand up paddling board has thicker wings, a shorter strut, box placement near the tail, is adjusted based on riders weight, and has a thinner foil section with a 50% maximum thickness position for strut. The specific design of a foil to provide the aforementioned advantages is discussed in more detail herein. Notably, while FIG. 1 illustrates the use of the disclosed apparatus in connection with a surfboard, the designs disclosed herein are not intended to be limited to such uses. Indeed, the disclosed apparatuses may be used with any type of watercraft including sailboats, powered vessels, and other watercraft.

FIGS. 2-7 are diagrams illustrating perspective, top, bottom, front, back and side views (respectively) of a hydrofoil, according to some embodiments of the disclosure As illustrated in FIGS. 2-7, a hydrofoil apparatus 100 includes a strut 104, a fuselage 106, a main lifting foil portion 108, an opposite foil portion 110, and a connection mechanism 112.

In the illustrated embodiment, connection mechanism 112 may comprise a Tuttle box installed in a surfboard 102 by routing a cavity within board 102 and placing connection mechanism 112 within the routed cavity. In some embodiments, connection mechanism 112 may comprise any fin box known in the art. Generally, connection mechanism 112 may comprise a rectangular solid portion with a cavity or hole centered within the box for the insertion of hydrofoil apparatus 100. Although illustrated, connection mechanism 112 may not be necessary if the hydrofoil apparatus 100 is utilized with other watercraft. Alternatively, strut 104 may be directly fused to a watercraft in certain circumstances. The connection of a hydrofoil to watercraft is known by those skilled in the art and various techniques may be used to connect the hydrofoil apparatus 100 to alternative crafts.

Hydrofoil apparatus 100 additionally includes a strut 104 that may be fixed within connection mechanism 112 or other connection means depending on the type of watercraft. In some embodiments, strut 104 may be fixedly connected to connection mechanism 112 via a sealant or other adhesive as known in the art. As illustrated in the Figures, strut 104 may be connected perpendicular to board 102, although in alternative embodiments strut 104 may be connected to board 102 at an angle. Additionally, while illustrated as a surfboard, board 102 may be any surface of a watercraft.

In some embodiments, the length of strut 104 (also referred to as the "height" of strut 104 relative to the surface of the board 102) may be determined based on the intended use of the board 102 or of the rider of the board 102 as discussed in more detail herein.

In the prior art, foils such as kite foils or windsurfing foils were generally placed at significant distance from surfboards or other boards. For example, a common strut length for such devices may be 38 inches. In general, it is difficult to use existing foils with long struts to generate lift and control the board simultaneously. Furthermore, longer struts tended to be dangerous as well with uncontrollable leverage and flipping straight out from under the board. Thus, the standard 38 inch or more height of strut for kite foils and windsurf foils are not desirable for activities such as stand up paddle surfing and stand up paddle boarding, as it creates uncontrollable wipeouts and creates a harder foil to lift out of the water because of more friction through the water in general.

In contrast, the hydrofoil apparatus 100 has a strut of significantly shorter length than existing foil apparatuses. This reduced length results in increased control of the board 102 when in operation.

In one embodiment, the height of strut 104 is approximately 18 to 30 inches, depending on the intended use. In one embodiment, strut 104 may be 19 to 24.5 inches, when measured from the bottom of the board 102 (when mounted) to the top of the fuselage 106 of the apparatus 100 (the "tee" portion on top of strut 104).

In one embodiment, the hydrofoil apparatus 100 may further be configured to have a thinner strut 104 for less drag that has a 50% foil section. A 50% foil section refers to the maximum thickness at the middle of strut 104 and that strut 104 will be more neutral and create less sideways lift from strut 104. As used herein the "middle" of strut 104 refers to a midpoint in the chord length of strut 104. That is, the vertical axis of strut 104 as compared to the horizontal axis relative to the board 102.

In one embodiment, strut 104 is between 6 and 12 millimeters thick at the maximum point of thickness in the middle of strut 104 while the aft and forward edges of strut 104 are between 3 and 6 millimeters. In another embodiment, strut 104 is 6 to 16 millimeters thick at the maximum point of thickness in the middle of strut 104 while the aft and forward edges of strut 104 are between 3 and 6 millimeters. Generally, the fore and aft edges of strut 104 may be of a first thickness where as a middle portion of strut 104 may be of a second thickness wherein the second thickness is twice the thickness of the fore and aft portions of strut 104.

Figure 10:
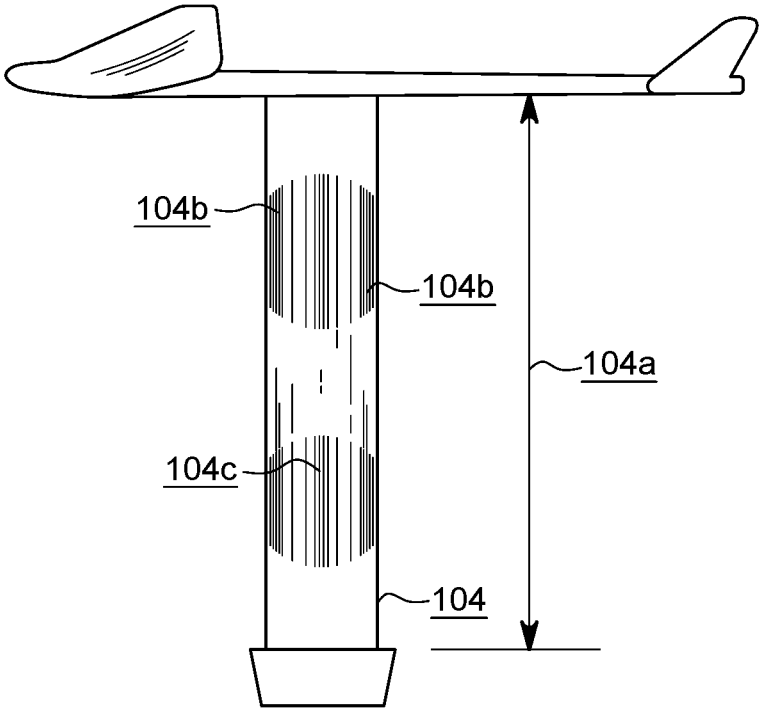
FIG. 10 is a diagram illustrating a cross-section view of a strut for use in a hydrofoil apparatus according to one embodiment of the disclosure.

FIG. 10 is a diagram illustrating a cross-section view of a strut for use in a hydrofoil apparatus according to one embodiment of the disclosure. As illustrated in FIG. 10, a strut 104 may be configured to have a height 104*a* between 20 inches to 30 inches in contrast to existing strut lengths of 35 to 43 inches. Additionally, as illustrated in FIG. 10, the fore and aft edges (104*b*) may be configured to be thinner than mid-portion 104*c* of strut 104. In the illustrated embodiment, for example, edges 104*b* may have a thickness of less than 12 millimeters. In contrast, mid-portion 104*c* may have a maximum thickness area of between 45% and 55% from the edges 104*b*.

Strut 104 connects the board 102 to fuselage 106. As illustrated, fuselage 106 comprises a horizontal support substantially parallel to the midline of board 102 and perpendicular to strut 104. In one embodiment, strut 104 may connect to fuselage 106 at a midpoint of the fuselage. In alternative embodiments, strut 104 may connect to fuselage 106 nearer towards main lifting foil portion 108.

In some embodiments, fuselage 106 may be tapered. In some embodiments, fuselage 106 may include a narrower aft end (i.e., toward opposite foil portion 110) and a wider fore end (i.e., toward main lifting foil portion 108). In some embodiments, the perimeter of fuselage 106 may be rectangular whereas in other embodiments fuselage 106 may be rounded.

In some embodiments, fuselage 106 may be flexible such that main lifting foil portion 108 and opposite foil portion 110 are able to flex up and down (i.e., toward and away from board 102). Such an effect mimics the motion of the wings of a bird and is particularly useful when utilized in flat-water racing. Additionally, the added up and down movement allowed by the flex in fuselage 106 is enhanced when rider is bouncing or shifting his weight up and down vertically (referred to as "pumping" the foil). A pumping motion induces more water flow over the wings of main lifting foil portion 108 and opposite foil portion 110, creates an earlier planning foil speed and overcomes the problem of current foils that require extra knots of speed to foil. Pumping the hydrofoil apparatus 100 can also extend the foiling time above the water if maintained.

In some embodiments, the length of fuselage 106 may be determined based on the needs of the rider. In one embodiment, fuselage 106 may be approximately 30 inches in length. Longer fuselage will stabilize foils up and down movement but will restrict turning capabilities.

Connected at the fore of fuselage 106 is a main lifting foil portion 108. As illustrated, for example, in FIG. 2, main lifting foil portion 108 may comprise a singular anhedral-shaped foil portion. That is, a single foil portion with two wing segments turning opposite board 102. In some embodiments, main lifting foil portion 108 may be flat with tipped wing portions. As illustrated, main lifting foil portion 108 may additionally include a receptacle allowing for the insertion and fixing of fuselage 106. Alternatively main lifting foil portion 108 (or opposite foil portion 110) may be fixedly connected to fuselage 106 by connecting the portions 108, 110 on the top side of fuselage 106.

In the illustrated embodiment, the main lifting foil portion 108 may be connected to the fore end of fuselage 106. In this embodiment, the main lifting foil portion 108 may be referred to as the "forward foil portion" wherein the opposite foil portion 110 is connected to the aft end of fuselage 106 and may be referred to as the "back foil portion". In alternative embodiments wherein the apparatus 100 is configured in a Canard style setup, main lifting foil portion 108 may be connected to the aft end of fuselage 106 while opposite foil portion 110 may be connected to the fore end of fuselage 106.

In one embodiment, the main lifting foil portion 108 may be 610 millimeters in length (i.e., the wing span of main lifting foil portion 108) and 255 millimeters in width (i.e., the chord width of main lifting foil portion 108).

Additionally, the main lifting foil portion 108 may be of varying thickness across the chord width of the main lifting foil portion 108. Specifically, main lifting foil portion 108 may include a thicker portion a predefined distance from the forward edge of the main lifting foil portion 108.

In some embodiments, the ratio of thickness between the aft and fore edges of the main lifting foil portion 108 and the thickest point along the chord length of the main lifting foil portion 108 may be between 14% and 17%. In one embodiment, the thickest portion of the main lifting foil portion 108 may comprise a thickness of 25 to 45 millimeters. In another embodiment, the thickest portion of the main lifting foil portion 108 may comprise a thickness of 55 millimeters, or 25 to 65 millimeters. In contrast, thickest sections of existing hydrofoils for kite board, windsurf, standup paddle boards and surfboards are currently between 13 and 18 millimeters.

In one embodiment, the thickest point of the main lifting foil portion 108 may located be offset from the forward edge of the main lifting foil portion 108 according to a predetermined distance. In some embodiments, the portion of the main lifting foil portion 108 having maximum thickness may be located at 20 to 33 percent of the chord length as measured from the forward edge of the main lifting foil portion 108. That is, the thickest portion of main lifting foil portion 108 may run from tip to tip at a position 20%30% from the fore edge of the main lifting foil portion 108. In contrast, existing foil designs generally place the thickest portion of the foil wing at approximately 35% to 50% from the fore edge. Thus, in the illustrated embodiments the thickest portion of the main lifting foil portion 108 is located significantly more towards the fore than existing designs.

In one embodiment, main lifting foil portion 108 may have a maximum thickness of 35 millimeters. In this embodiment, a main lifting foil portion 108 with a maximum thickness of 35 millimeters may be utilized for riders having a weight of between 175 and 250 pounds.

In an alternative embodiment, main lifting foil portion 108 may have a maximum thickness of 30 millimeters, a main lifting foil portion 108 length of 550 millimeters, and a main lifting foil portion 108 width of 200 millimeters. In this embodiment, the dimensions may be utilized for smaller riders having a weight between 75 and 150 pounds.

In one embodiment, the main lifting foil portion 108 may comprise an outer, hardened shell (e.g., of plastic, fiberglass, or other material) and may include a foam interior to increase buoyancy which adds to the lift and helps with flexing characteristic for the bird flapping effect discussed with respect to fuselage 106.

Figure 9:
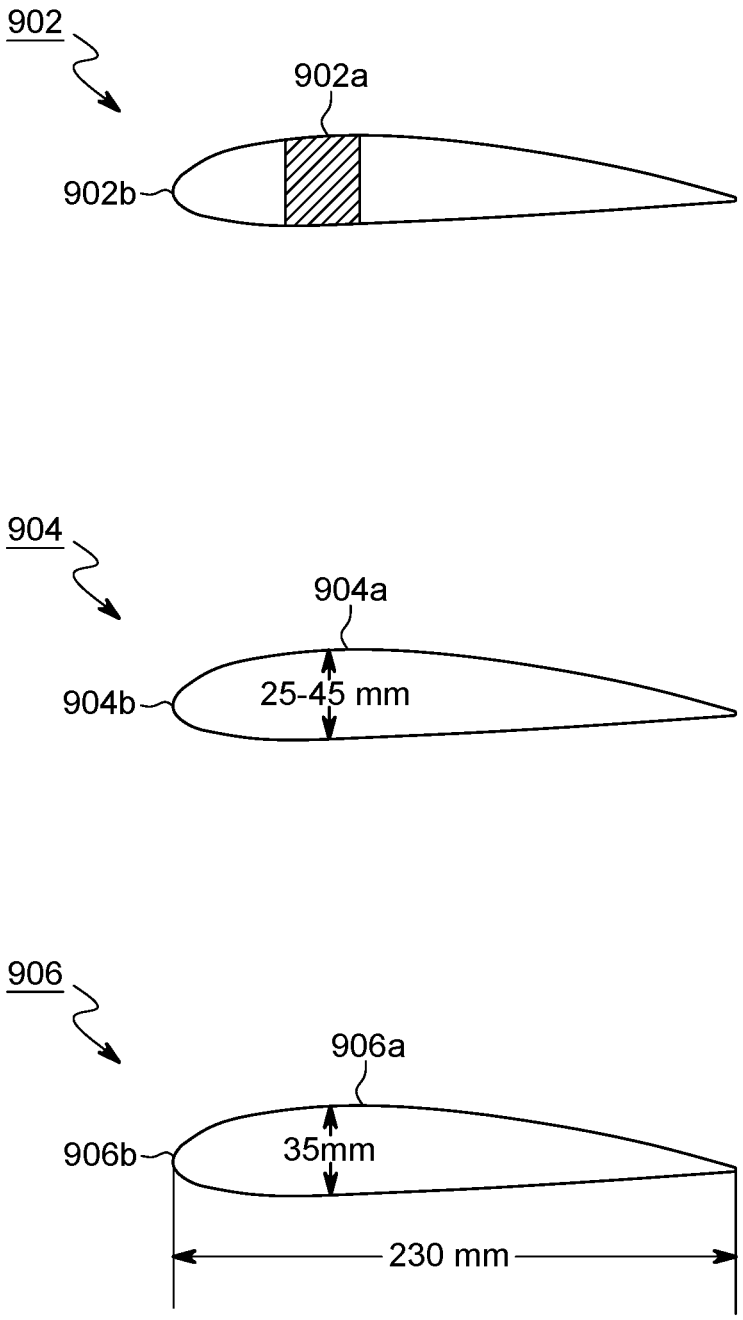
FIG. 9 is a diagram illustrating a cross-sectional view of a hydrofoil according to some embodiments of the disclosure.

FIG. 9 is a diagram illustrating the dimensions of a hydrofoil according to some embodiments of the disclosure.

As illustrated in FIG. 9, hydrofoil embodiments 902, 904, and 906 each have a maximum thickness (902*a*, 904*a*, 906*a*) located towards the fore edges 902*b*, 904*b*, 906*b*, respectively, of hydrofoils 902, 904, and 906.

As illustrated by hydrofoil 902, the hydrofoil 902 includes a maximum thickness occurring at a distance between 20% and 33% of the chord length as measured from the fore edge 902*b* of hydrofoil 902. As illustrated by hydrofoil 904, in one embodiment, the maximum thickness may be between 24 and 45 millimeters and, likewise, may appear at a distance between 20% and 33% of the chord length as measured from the fore edge 904*b* of hydrofoil 904. In the illustrated example, the maximum thickness of hydrofoil 904 may occur at, for example, 27% of the chord length as measured from the fore edge 904*b* of hydrofoil 904.

As illustrated by hydrofoil 906, the maximum thickness may be determined as a function of the chord length. As illustrated, the chord length of hydrofoil 906 may be 230 millimeters. In this embodiment, the max thickness may be determined by using a maximum thickness aspect ratio of between 14 and 17 percent of the chord length. Specifically, the maximum thickness aspect ratio is equal to the maximum thickness divided by the chord length of the foil. Thus, as illustrated by hydrofoil 906, the maximum thickness may be computed as 35 millimeters, or, 15.2% of the total chord length. As discussed with respect to hydrofoils 902 and 904, the maximum thickness may be located at a distance between 20% and 33% of the chord length as measured from the fore edge 906*b* of hydrofoil 906.

Connected at the aft end of fuselage 106 is a opposite foil portion 110. In some embodiments, the design of opposite foil portion 110 may similar to that of main lifting foil portion 108, the details of which were discussed previously and are included herein by reference in their entirety. Notably, opposite foil portion 110, while maintaining a varied thickness, is generally smaller (in all dimensions) than main lifting foil portion 108. In an alternative embodiment, the back foil is bigger the front foil and is the main lifting foil.

In one embodiment, the opposite foil portion 110 is adjustable and can be changed for angle of attack to induce more or less lift based on the rider's needs (e.g., the rider's weight, position on board, or paddling capabilities). Too much lift or angle of attack with of the opposite foil portion 110 will lead to over foiling and surfacing the main lifting foil portion 108 which will create stall and usually foil will come back down, sometimes inducing a crash or rider falling off. As described in connection with main lifting foil portion 108, opposite foil portion 110 may be shaped at an anhedral angle. In some embodiments, opposite foil portion 110 may be situated such that the tips of opposite foil portion 110 may point upward (e.g., away from fuselage 106).

The flexible wing and flexible fuselage mentioned above can be both used as alternative solutions for slower speed applications like flat-water standup performance where foiling is very hard to attain at the present.

When an adjustable back wing is used, it is adjusted and locked before the ride. The wing is locked into a position before getting into the water. A flexing counter levering can be used on the back or even the front wing.

Figure 8:
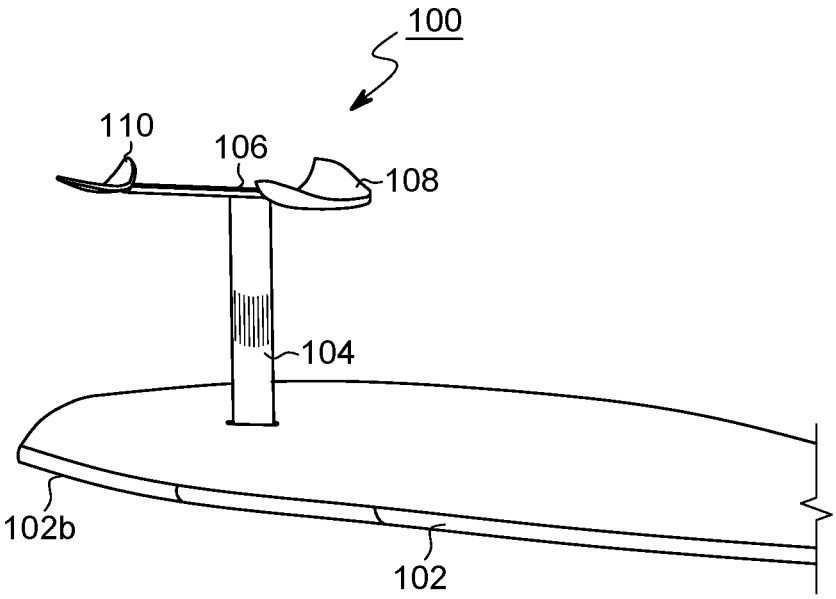
FIG. 8 is a diagram illustrating a hydrofoil apparatus attached to a surfboard, according to some embodiments of the disclosure.

FIG. 8 is a diagram illustrating a hydrofoil apparatus attached to a surfboard, according to some embodiments of the disclosure.

As illustrated in FIG. 8, a board 102 may be equipped with a hydrofoil apparatus 100 including a strut 104, fuselage 106, main lifting foil portion 108, and opposite foil portion 110 via a connection mechanism 112.

In one embodiment, the hydrofoil apparatus 100 is mounted at a preferred distance (e.g., about 23 inches) from the tail of the board 102. If the existing mounting setup on the board 102 is too far away from the tail, the tail may be cut to shorten the distance between the mounting point of strut 104 to the board 102 (e.g., the joined portion of strut 104 and board 102 to the tail of the board).

Lighter riders need less lift and thus much different forward and aft wing sizes and can use different box placements, as discussed previously. For instance, a 75 pound rider may be required to get fully forward to keep the board down because of his or her light weight. Conversely, a heavier rider will be required to move further back to create the needed lift.

Preferably, the board has a narrower tail with a rocker.

In one embodiment, strut 104 is positioned 13 to 30 inches from tail to back edge of connection mechanism 112 that secures strut 104 to the board (when strut 104 is vertical of bottom of board). In another embodiment, strut 104 is positioned 5 to 34 inches from tail to back edge of connection mechanism 112, and in another embodiment 7 to 32 inches from tail to back edge of connection mechanism 112. Adjustments can be made when a strut 104 is racked forward or aft. The distance of 13 to 16 inches is preferable for the light weight riders (e.g., 75-150 pounds), 18 to 20 inches for average weight riders (e.g., 150-200 pounds), and 20 to 23 inches for heavier weight riders (e.g., 200 pounds).

If strut 104 is racked forward or aft, the horizontal distance between the center of the main lifting foil portion 108 to the tail of the board 102 may be more critical than the horizontal distance between the mounting point of strut 104 (i.e., where strut 104 is secured to the board 102) and the tail of the board 102. In such situations, the mounting location would be adjusted to keep the horizontal distance between the center of the main lifting foil portion 108 to the tail of the board 102 similar to that of a strut 104 that is mounted perpendicular to the board 102.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results. Only a few examples and implementations are disclosed. Variations, modifications and enhancements to the described examples and implementations and other implementations may be made based on what is disclosed.

What is claimed is:

1. An apparatus comprising:

a strut, configured for mounting to a paddle board, having a variable thickness and a maximum thickness located midway along a chord length of the strut, wherein the strut is further configured to extend below a water surface when the board is paddled;

a fuselage connected to the strut;

an anhedral, flat or dihedral shaped, back foil portion connected to an aft end of the fuselage; and an anhedral-shaped forward foil portion connected to a fore end of the fuselage, wherein the forward foil portion includes two front wings extending outwardly from the fore end of the fuselage, the forward foil portion is configured to provide lift for supporting the paddle board above the water surface when the board is paddled, and a thickest portion of the forward foil portion is offset from a forward edge of the forward foil portion and has a thickness of 25 to 65 millimeters.

2. The apparatus of claim 1, wherein the fuselage is less than 36 inches in length.

3. An apparatus comprising:

a strut configured for mounting to a board, and to extend below a water surface when the board is traveling;

a fuselage connected to the strut;

an opposite foil portion connected to a first end of the fuselage wherein the opposite foil portion includes two wings extending outwardly from the first end of the fuselage; and a main lifting foil portion connected to a second end of the fuselage, wherein the main lifting foil portion includes two wings extending outwardly from the second end of the fuselage, the main lifting foil portion is configured to provide lift for supporting the board above the water surface when the board is traveling, a thickest portion of the main lifting foil portion is offset from a forward edge of the main lifting foil portion, and the thickest portion is located at a position 20 to 33 percent of a chord length as measured from the forward edge.

4. The apparatus of claim 3, wherein the opposite foil portion is adjustable to change for angle of attack.

5. The apparatus of claim 3, wherein the main lifting foil portion and opposite foil portion are anhedral-shaped.

6. The apparatus of claim 3, wherein the opposite foil portion and main lifting foil portion are constructed using a flexible material.

7. The apparatus of claim 3, wherein the main lifting foil portion comprises an outer, hardened shell.

8. The apparatus of claim 3, wherein the main lifting foil portion comprises a foam interior.

9. A watercraft comprising:

a board having a tail end;

a strut mounted to the board, the strut configured to extend below a water surface when the board is traveling;

a fuselage connected to the strut;

an opposite foil portion connected to a first end of the fuselage; and a main lifting foil portion connected to a second end of the fuselage, wherein the main lifting foil portion includes two wings extending outwardly from the second end of the fuselage, the main lifting foil portion is configured to provide lift for supporting the board above the water surface when the board is traveling, and the thickest portion of the main lifting foil portion is offset from a forward edge of the main lifting foil portion by less than 33 percent along a chord length as measured from the forward edge.

10. The watercraft of claim 9, wherein the main lifting foil portion and opposite foil portion are anhedral-shaped.

11. The watercraft of claim 9, wherein the fuselage is less than 36 inches in length.

12. The watercraft of claim 9, wherein the opposite foil portion is constructed using a flexible material.

13. The apparatus of claim 1, wherein the thickest portion runs from tip to tip of the forward foil portion.

14. The apparatus of claim 3, wherein the thickest portion runs from tip to tip of the main lifting foil portion.

15. The watercraft of claim 9, wherein the thickest portion has a thickness of 25 to 65 millimeters.

16. The apparatus of claim 1, wherein the thickest portion is located at a position 20 to 33 percent of a chord length as measured from the forward edge of the forward foil portion.

17. The watercraft of claim 9, wherein the main lifting foil portion comprises an outer, hardened shell, and further comprises a foam interior.

* * * * *